United States Patent [19]

Marrese

[11] Patent Number: 4,750,977

[45] Date of Patent: Jun. 14, 1988

[54] ELECTROCHEMICAL PLATING OF PLATINUM BLACK UTILIZING ULTRASONIC AGITATION

[75] Inventor: Carl A. Marrese, Pittsburgh, Pa.

[73] Assignee: Bacharach, Inc., Pittsburgh, Pa.

[21] Appl. No.: 943,254

[22] Filed: Dec. 17, 1986

[51] Int. Cl.[4] ..... C25D 3/50; C25D 3/52

[52] U.S. Cl. ..... 204/27; 204/44.6; 204/47

[58] Field of Search ..... 204/44.6, 47, 273, 261, 204/290 R, 44, 27

[56] References Cited

U.S. PATENT DOCUMENTS 4,152,233 5/1979 Chand ..... 204/195 P

OTHER PUBLICATIONS

A. M. Feltham and M. Spiro, "Platinized Platinum Electrodes", 71 Chem. Rev. 177–193 (1971).

S. I. Uspenskii and M. A. Shluger, "The Effect of Ultrasonics on Cu Electrodeposition", 2 Elektrokhimiya 243 (1966), English language abstract only.

S. R. Rich, "Improvement in Electroplating Due to Ultrasonics", 42 Plating 1407–1411, and title page (1955).

F. I. Kukoz and L. A. Kokoz, "Formation of Nonporous Galvanic Deposits of Platinum in an Ultrasonic Field", 39 Zh.Prikl.Khim 705–707 (1966).

V. Cupr, "The Use of Ultrasonic Waves in Electrochemistry", 32 Chem. Listy 215–218 (1938). Czech article and English translation.

*Primary Examiner*—G. L. Kaplan

*Attorney, Agent, or Firm*—Webb, Burden, Robinson & Webb

[57] ABSTRACT

Platinum black is electrochemically plated onto a conductive substrate, such as a platinum electrode, by positioning a counter electrode and the conductive substrate in a platinum(IV) ion plating solution. An electric current is passed through the counter electrode, substrate and plating solution for a predetermined period of time. The plating solution and conductive substrate are subjected to ultrasonic agitation while the plating is carried out. The plating solution preferably includes chloroplatinic acid and lead ion.

9 Claims, 2 Drawing Sheets

ELECTROCHEMICAL PLATING OF PLATINUM BLACK UTILIZING ULTRASONIC AGITATION

BACKGROUND OF THE INVENTION (1) Field of the Invention

This invention relates to the plating of platinum black on conductive substrates and, more particularly, to a method and apparatus for electrochemically plating platinum black on the outer surface of a conductive substrate while simultaneously subjecting the substrate to ultrasonic agitation.

(2) Background Art

Platinum black is a finely reduced platinum metal having a particle size of one micron or less. The particles may be as small as several hundred Angstroms in diameter. Although platinum black is pure platinum metal, a layer or film of platinum black particles appears to be black in color due to the small size of the particles.

Electrodes made of platinum and coated with platinum black are widely used as measuring electrodes. Platinum black coated electrodes, particularly thin platinum wires coated with platinum black, have been used as current collectors and oxygen reference electrodes in toxic gas sensors. One example of a toxic gas sensor is shown in U.S. Pat. No. 4,152,233, which is owned by the assignee of the present application. The platinum black coating on a platinum electrode is rather porous in nature and, as a result, increases the electrical contact area and catalytic reaction area in a gas diffusion electrode, and improves the stability of reference potentials in a reference electrode.

Presently platinum black is deposited onto conductive substrates by the electrochemical reduction of platinum(IV) complexes, usually $H_2PtCl_6$, in a plating solution. Lead ion or the like may be added to the plating solution in order to improve the adherence of the platinum black coating to the underlying substrate. A discussion of current methods of electrochemically plating platinum black on a conductive substrate, particularly a platinum substrate, and the chemistry involved is given in an article by A. M. Feltham and M. Spiro, *Platinized Platinum Electrodes,* 71 Chem. Rev. 177 (1971). The platinum black coatings plated in accordance with the methods disclosed in the Feltham article, even when plated in the presence of a lead ion, are not strongly bound to the substrate. It has been found that during operation of a toxic gas sensor which includes a platinum black coated platinum electrode the platinum black coating has often completely fallen off after only several weeks of use.

It has been suggested in the prior art that annealing or sintering of plated substrates after electrodeposition will increase the strength and durability of the plated coating. However, annealing is an additional, time consuming step which also leads to a reduction in the electrochemical surface area of a platinum black coating on an electrode.

The use of ultrasonic agitation in connection with plating of copper is known in the art. S. I. Uspenskii et al., *The Effect of Ultrasonics on Cu Electrodeposition,* 2 Elektrokhimiya 243 (1966). Ultrasonic is a term given to the physical vibration of particles at frequencies above the auditory limit of the human ear or above approximately 16,000 cycles per second. In practice, the ultrasonic frequency spectrum includes frequencies in the range of 16,000 cycles per second to several million cycles per second or higher. Ultrasonic agitation has been used in conjunction with the electroplating of cadmium, copper, silver, chromium and nickel, S. R. Rich, *Improvement in Electroplating Due to Ultrasonics,* 42 Plating 1407 (1955), and for the electroplating of smooth, poreless platinum on copper, F. I. Kukoz et al., *Formation of Nonporous Galvanic Deposits of Platinum in an Ultrasonic Field,* 39 Zh. Prikl. Khim 705 (1966). However, the prior art has in no way taught or suggested that ultrasonic agitation may be used in conjunction with the electrochemical plating of platinum black on a conductive substrate, particularly a platinum substrate.

It is an object of the present invention to plate, on a conductive substrate, a platinum black coating which is highly adherent to the substrate and will remain on the substrate during use as an electrode or the like.

A further object of the present invention is to plate a durable platinum black coating on a conductive substrate without increasing the time needed to carry out the plating process and without decreasing the electrochemical surface area of the coating.

SUMMARY OF THE INVENTION

Accordingly, I have invented a method and apparatus for electrochemically plating a layer of platinum black onto a conductive substrate which includes the use of ultrasonic agitation. In the method, a counter electrode and the conductive substrate are positioned in a platinum(IV) ion plating solution. An electric current is passed through the counter electrode and the plating solution for a predetermined period of time. The plating solution and conductive substrate are simultaneously subjected to ultrasonic agitation.

The ultrasonic agitation may be provided by an ultrasonic cleaner. The plating solution preferably includes chloroplatinic acid, but may also include bromoplatinic acid. The plating solution may further include an additive such as lead ion, copper ion, or mercury ion. A preferred plating solution includes chloroplatinic acid and lead ion.

The invention is particularly useful for plating a layer of platinum black onto a platinum electrode, such as a platinum wire electrode.

DESCRIPTION OF THE PREFERRED EMBODIMENT

Figure 1:
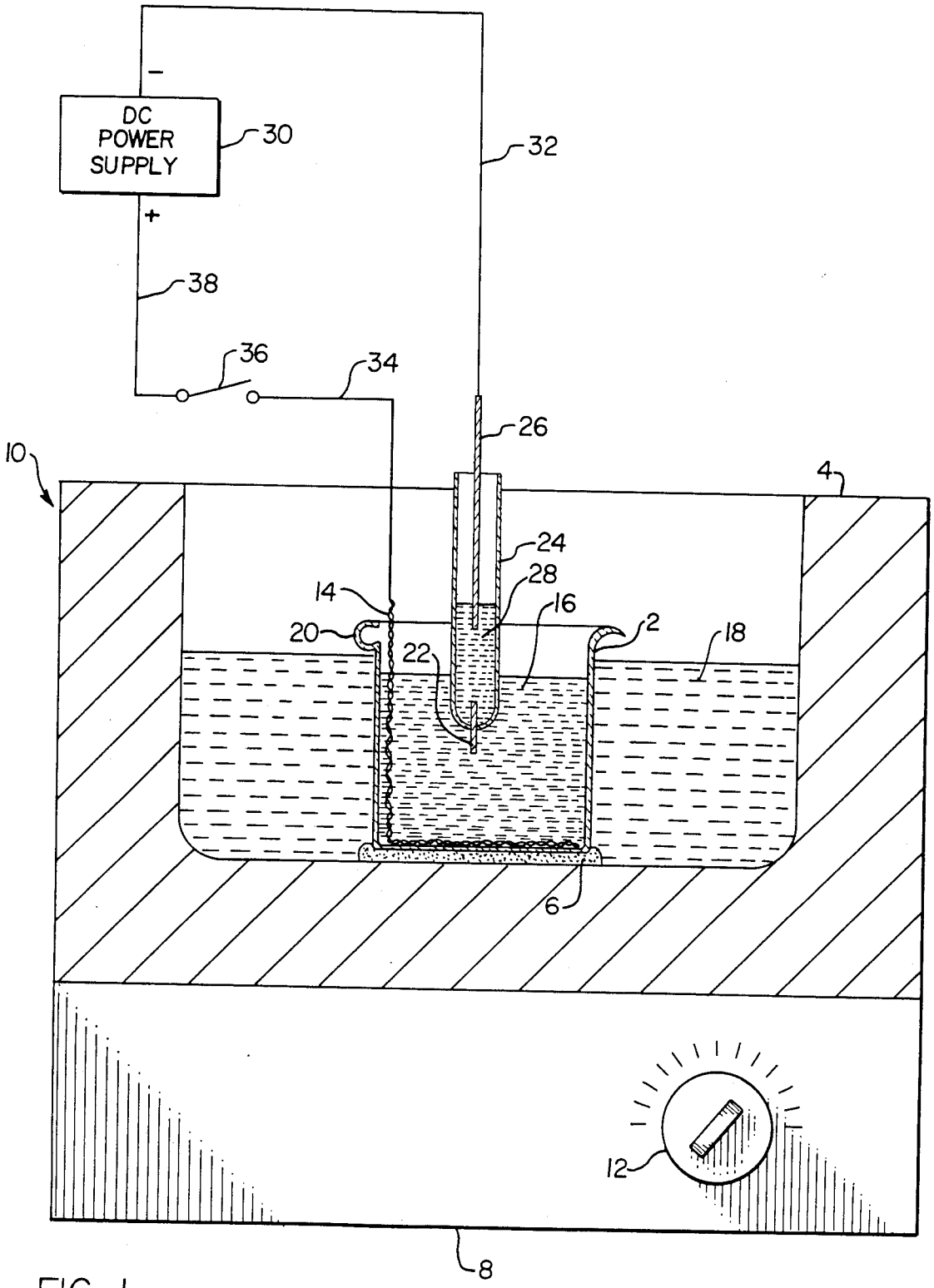
FIG. 1 is a schematic view of a preferred apparatus for carrying out the method of the present invention.

An apparatus suitable for carrying out the method of the present invention is shown in FIG. 1. A plating cell, such as an open-topped, glass beaker 2, is secured to the bottom of an ultrasonic vibration tub, preferably a metal tub 4, by an adhesive 6 or the like. The metal tub 4 is secured to the base 8 of an ultrasonic vibrator 10. The base 8 contains a transducer and related control circuitry which, as is known in the art, will ultrasonically agitate the metal tub 4 and, hence, the beaker 2 secured thereto. The ultrasonic vibrator 10 is controlled by a timer 12, which also turns the vibrator 10 on and off. The vibrator 10 is connected to a suitable source of power (not shown).

A counter electrode 14, such as a braided platinum wire, is inserted in the beaker 2 and extends outwardly therefrom. A liquid plating solution 16 is placed in the beaker 2 and substantially covers the counter electrode 14. A liquid 18, such as water, is placed in the metal tub 4 and covers substantially the exterior surface of the beaker 2, preferably extending to a level immediately beneath the rim 20 of the beaker 2. As is known in the art, the liquid 18 in the metal tub 4 aids in transmitting the ultrasonic agitation to the beaker 2 and its contents.

An electrode 22 to be plated by the method of the present invention is held at the bottom end of a hollow, open-topped glass tube 24 and extends from the interior to the exterior of the glass tube 24. Tube 24 is preferably made of a soft glass. Electrode 22 is a thin, platinum wire as shown in FIG. 1, but other shapes and materials for the electrode 22 are possible. A copper wire 26 is positioned within the glass tube 24 and extends through the open top thereof. Electrical contact between the copper wire 26 and the electrode 22 is made by placing liquid mercury 28 in the glass tube 24 and covering the upper end of the electrode 22 and the lower end of the copper wire 26 with the liquid mercury 28.

The glass tube 24 is disposed in the plating solution 16 to a depth such that the lower end of the tube 24 and, accordingly, the portion of the electrode 22 outside and secured to the glass tube 24 are completely submerged in the plating solution 16. The copper wire 26 is connected to the negative terminal of a DC power supply 30 by wire 32 and the counter electrode 14 is connected to the positive terminal of the DC power supply 30 by wire 34, switch 36 and wire 38. The DC power supply 30 provides an electric current through the counter electrode 14, plating solution 16 and the electrode 22, and the electrochemical plating of electrode 22 is carried out in a manner well known in the art.

The plating solution 16 in the beaker 2 can be any of the platinum(IV) ion plating solutions which are known in the art and have been used for plating platinum black on conductive substrates. A commonly used, and preferred, solution for plating platinum black on a platinum substrate includes chloroplatinic acid. The plating solution may also include bromoplatinic acid. The chloroplatinic and bromoplatinic acid plating solutions can be generated in aqua regia or other acidic solutions by their respective salts, for example, potassium hexachloroplatinum(IV) or potassium hexabromoplatinum(IV). The plating solution may further include a small amount of an additive such as copper ion, lead ion, or mercury ion. A preferred additive to a chloroplatinic acid plating solution, particularly when plating platinum black on platinum substrates, is lead ion. A plating solution with an ionic additive improves plating of the platinum black when compared to a pure platinum(IV) plating solution. A complete discussion of the electrochemical plating of platinum black is given in the Feltham et al. article.

The method of the present invention includes the further step of subjecting the electrode 22 to ultrasonic agitation at the same time the electrochemical plating operation is being carried out. With reference to FIG. 1, after the apparatus has been set up and the lower end of the glass tube 24 holding the electrode 22 has been inserted into the plating solution 16, the DC power supply 30 is adjusted to a desired level, typically in the 1–2.5 volt range, and the switch 36 is closed, thus delivering the electrical power necessary to carry out the electrochemical plating operation. Simultaneously, the timer 12 of the vibrator 10 is manually rotated, thus causing the electrode 22, as well as the plating solution 16, to be subjected to the ultrasonic agitation generated by the vibrator 10. The vibrator 10 will remain on and ultrasonically agitate the electrode 22 and plating solution 16 during the entire plating operation. The simultaneous plating and ultrasonic agitation can be carried out for as long a period of time as desired. Time periods of from 2 to 6 minutes have been found to be suitable for plating platinum black on thin platinum wires. Thereafter, timer 12 will automatically shut off and the switch 30 is manually opened. The glass tube 24 is then removed from the plating solution 16, the electrode 22 is removed from the glass tube 24, and the electrode 22 is rinsed with water or the like to remove any trace of the liquid plating solution 16.

While the method has been described in connection with a single, thin wire electrode, it can easily be carried out with conductive substrates having other shapes and configurations. Likewise, a plurality of substrates can be coated at the same time by merely connecting each to the negative terminal of the DC power supply 30, inserting the substrates into the plating solution 16 and carrying out the plating steps as described above.

It has been found that platinum wire electrodes coated with platinum black in accordance with the method of the present invention are much more durable and have a higher measured electrochemical surface area than platinum wire electrodes coated with platinum black without the use of ultrasonic agitation. The increase in durability is believed to be a result of weakly plated particles being knocked off the electrode during the plating process, thus leaving only the more firmly attached particles on the electrode. It is believed that the increased electrochemical electrode surface area is a result of an increase in the flux of the platinum(IV) ion in the plating solution during ultrasonic agitation. In particular, the ultrasonic agitation increases the flux of the $PtCl_6^{2-}$ ion in a chloroplatinic acid plating solution. The size of the particles of platinum black that remain is believed to be smaller than the size of the particles that remain without the ultrasonic agitation and this particle size difference contributes to the increase in durability and increase in electrochemical surface area.

The following examples are illustrative of the platinum black plating method of the present invention.

EXAMPLE I

A single electrode was manufactured in an experimental arrangement by plating platinum black on a length of 0.005 inch diameter platinum wire. The apparatus shown in FIG. 1 was utilized for producing this electrode. The ultrasonic agitation was supplied by a Sonicor, Model SC-50TH ultrasonic cleaner having a one liter tub and a power output of 50 watts. The cleaner had a transducer operating frequency of 60,000 cycles per second. The plating current was supplied from a Hewlett Packard Model 6202B DC power supply. The plating cell was a 50 mL beaker secured to the bottom of the ultrasonic tub with Dow Corning Silastic 730 RTV adhesive.

The platinum wire was sealed in the lower end of a hollow, soft glass tube and the exposed end of the wire outside of the glass tube was cut to a length of about 5.0 mm. Thus, the exposed wire had an outer geometric surface area of approximately 0.02 $cm^2$. Electrical contact with the end of the platinum wire inside the glass tube was made with liquid mercury. One end of a length of copper wire was inserted into the mercury so that it extended through the open end of the glass tube. The free end of the copper wire was connected to the negative terminal of the DC power supply.

The glass beaker contained a chloroplatinic acid plating solution of 1.4% $PtCl_6^{2-}$ and 0.02% $Pb^{++}$ in dilute aqua regia. The plating solution was prepared from 7.0 grams of the 0.005 inch diameter platinum wire in 100 mL of an aqua regia made from one part nitric acid ($HNO_3$) and three parts hydrochloric acid (HCl) which was diluted to 500 grams of solution with Fisher Scientific HPLC water, a high purity grade of water. Next, 0.1 gram of lead nitrate ($Pb(NO_3)_2$) was added to this dilute solution. The chloride content of the plating solution was low enough to not cause the precipitation of lead chloride ($PbCl_2$).

The counter electrode was a braided platinum wire which was coiled on a glass rod for support. The counter electrode was placed in the plating solution and electrically connected to the positive terminal of the DC power supply. The end of the glass tube holding the wire electrode was immersed in the plating solution until the exposed portion of the wire electrode and about 0.25 inch of the lower end of the glass tube were covered by the liquid plating solution. The temperature of the liquid bath in the tub surrounding the beaker remained at room temperature of 23° C.±2° C. To carry out the plating process, the ultrasonic cleaner was turned on, the DC power supply was turned on and set to a level of 2 volts, and the switch was closed to permit current flow.

The plating procedure was carried out for 2.5 minutes. Then, the power supply and ultrasonic cleaner were turned off, the glass tube was removed from the plating solution and the wire electrode was removed from the glass tube. The electrode was then rinsed several times with Fisher Scientific HPLC water.

The electrode surface area of the platinum black coated platinum wire electrode was determined electrochemically by the integration of the hydrogen adsorption processes in a cyclic voltammogram at 0.1 volt/second. The use of cyclic voltammetry to determine electrode surface areas is well known in the art. The cyclic voltammogram was generated with an EG & G Princeton Applied Research Model 273 Galvanostat/Potentiostat. Recordings were made on a Hewlett Packard Model 7044A x-y recorder. The electrolyte used in generating the voltammograms was one molar sulfuric acid ($H_2SO_4$) employing Fisher Scientific HPLC water. The voltammetric cell utilized was a conventional three-electrode cell, with the counter and reference compartments isolated from the working compartment with fine glass frits.

A cyclic voltammogram was generated using the apparatus described above for a length of the 0.005 inch diameter platinum wire without any coating.

Figure 2:
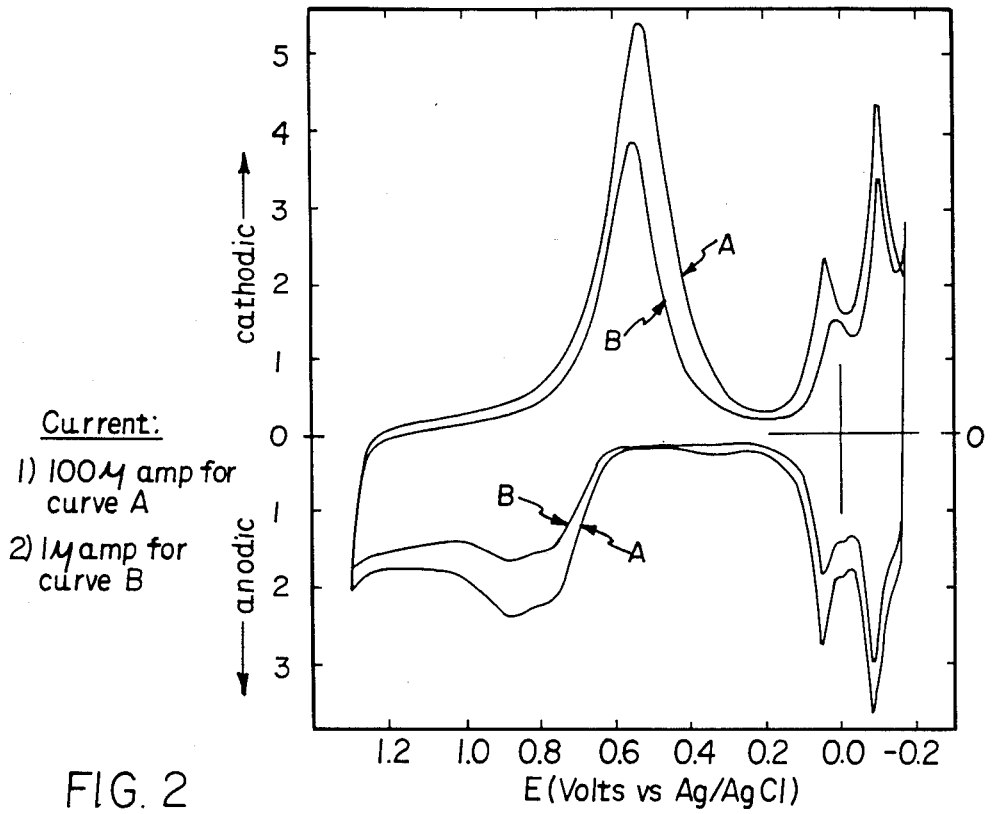
FIG. 2 is a graph of the surface voltammetry for a bare platinum wire and for a platinum wire plated with platinum black in accordance with the present invention.

FIG. 2 illustrates the characteristic surface voltammetry generated for the ultrasonically platinized wire (Curve A) and for the bare, unplatinized platinum wire (Curve B). The current scale for Curve A is 100 times the current scale for Curve B. The voltammograms clearly exhibit the hydrogen adsorption reductive processes (from +0.15 V to −0.18 V), uncomplicated by impurity adsorption, such as $Cl^-$. The large area under the hydrogen adsorption processes of the platinized wire shows that the method of the present invention produces a platinum black coating having a high surface area. The small oxidation at +0.35 V is believed to be due to the presence of lead from the plating solution. This oxidation is not present in the voltammogram for the unplatinized wire. Furthermore, the peak current is linear with potential sweep rate and decreases with increasing time for soaking in concentrated $HNO_3$. FIG. 2 also shows that the voltammetric curve for the platinized wire has the same general shape as that for the unplatinized platinum wire, even though lead is present to a small extent in the platinum black coating.

EXAMPLE II

Five platinum wires were coated with platinum black using the arrangement described in Example I and for plating durations of 0.5, 1.25, 2.0, 3.0 and 4.0 minutes, respectively. An additional five platinum wires were coated with platinum black using the arrangement described in Example I and also for plating durations of 0.5, 1.25, 2.0, 3.0 and 4.0 minutes, respectively, but without the use of simultaneous ultrasonic agitation. The electrochemical surface area of these ten platinized wire electrodes was determined by measuring the area beneath the hydrogen adsorption curves of a cyclic voltammogram generated for each electrode in accordance with the arrangement described in Example I. The measured electrochemical surface areas are plotted as a function of plating duration on the graph shown in FIG. 3, with Curve C representing the electrodes plated without simultaneous ultrasonic agitation and Curve D representing the electrodes plated with simultaneous ultrasonic agitation in accordance with the method of the present invention. Other than the presence or absence of ultrasonic agitation during the plating process, and the varying plating durations, the conditions under which all ten platinum wires were coated were identical.

The precise measured areas are also set forth below in Table I.

TABLE I

| Plating Duration (min.) | Surface Area when Plating with Ultrasonic Agitation ($cm^2$) | Surface Area when Plating without Ultrasonic Agitation ($cm^2$) |
|---|---|---|
| 0.50 | 1.10 | 0.51 |
| 1.25 | 1.75 | 1.40 |
| 2.00 | 6.43 | 1.64 |
| 3.00 | 10.12 | 2.78 |
| 4.00 | 17.33 | 2.90 |

Figure 3:
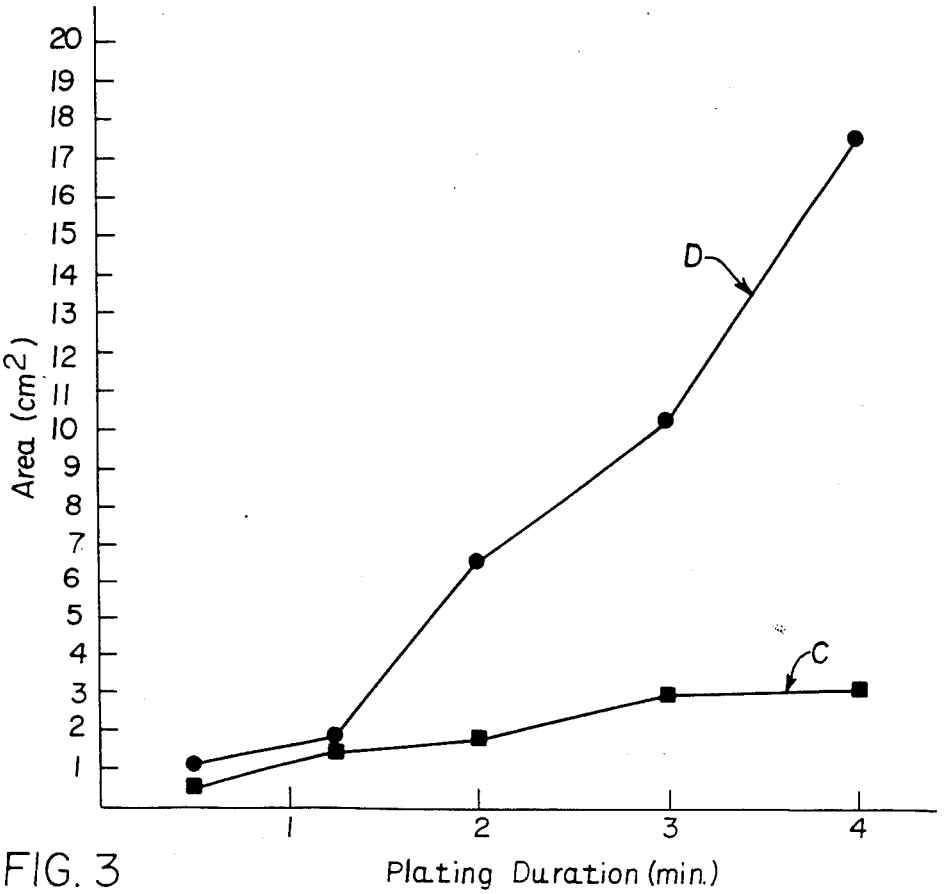
FIG. 3 is a graph showing the electrochemical surface area as a function of plating duration for various platinum black plated platinum wire electrodes.

In every instance, as Table I and the graph in FIG. 3 demonstrate, the wires which had been plated with the use of simultaneous ultrasonic agitation according to the present invention yielded an electrochemical surface area which was larger than the same wires plated without ultrasonic agitation. The increase in electrochemical surface area of the ultrasonically platinized wire over the non-ultrasonically platinized wire ranges from a 25% increase for a 1.25 minute plating duration to nearly a 600% increase for a plating duration of four minutes.

EXAMPLE III

Four platinum wire electrodes were separately platinized for 2.5 minutes using the arrangement described above in Example I and with the use of simultaneous ultrasonic agitation in accordance with the present invention. An additional four platinum wire electrodes were separately platinized for 2.5 minutes using the arrangement described in Example I, but without the use of simultaneous ultrasonic agitation. The electrochemical surface area of each of these eight electrodes was determined by generating a cyclic voltammogram using the arrangement described in Example I and integrating the area under the hydrogen adsorption curves of the voltammograms.

Each of these eight, plated electrodes was then subjected to ultrasonic cleaning in Fisher Scientific HPLC water for 2.5 minutes in the same ultrasonic cleaner used in the plating step. The electrochemical surface area of each electrode was once again determined by generating cyclic voltammograms and integrating the area under the hydrogen adsorption curves.

The electrochemical surface areas of the four electrodes plated with simultaneous ultrasonic agitation in accordance with the present invention, both before and after the subsequent ultrasonic cleaning step, were averaged and compared. Likewise, the areas of the four electrodes plated without simultaneous ultrasonic agitation, both before and after the subsequent ultrasonic cleaning step, were averaged and compared. The results are set forth below in Table II.

TABLE II

| Plating Method | Surface Area Before Cleaning | Surface Area After Cleaning | Loss |
|---|---|---|---|
| Ultrasonically Platinized | 10.7($cm^2$) | 10.4($cm^2$) | 2.5% |
| Non-Ultrasonically Platinized | 3.93($cm^2$) | 0.64($cm^2$) | 82% |

The wire electrodes prepared by the ultrasonic platinization method of the present invention had an average decrease in surface area of only about 3% and, thus, retained approximately 97% of the platinum black coating. The wire electrodes prepared without simultaneous ultrasonic agitation during the plating procedure had an average decrease in area of 82%. Dislodging of the platinum black from the wire electrodes was observed visually during the ultrasonic cleaning treatment. This shows that the loss in electrochemical area is clearly due to a loss of material from the platinum black coating. The dislodging of platinum black was much more pronounced for the electrodes plated without ultrasonic agitation than for the electrodes plated with simultaneous ultrasonic agitation in accordance with the present invention.

The platinum wires platinized with the aid of ultrasonic agitation exhibited high electrochemical surface areas and showed no evidence of failure due to the loss of the platinum black coating, even after several months in operation. The present method requires no additional time when compared to known methods, and requires only the addition of an ultrasonic cleaner.

Having described above the presently preferred embodiments of the present invention, it is to be understood that it may be otherwise embodied within the scope of the appended claims.

I claim:

1. A method of electrochemically plating a layer of platinum black onto a conductive substrate comprising the steps of positioning a counter electrode and a conductive substrate in a platinum(IV) ion plating solution and passing an electric current through said counter electrode, conductive substrate and plating solution while simultaneously subjecting said plating solution and said conductive substrate to ultrasonic agitation.

2. The method of claim 1 wherein said plating solution includes an acid selected from the group consisting of chloroplatinic acid and bromoplatinic acid.

3. The method of claim 2 wherein said plating solution further includes an additive selected from the group consisting of lead ion, copper ion, and mercury ion.

4. The method of claim 1 wherein said plating solution includes chloroplatinic acid.

5. The method of claim 4 wherein said plating solution further includes lead ion.

6. The method of claim 1 wherein said conductive substrate is a platinum electrode.

7. The method of claim 1 wherein said conductive substrate is a platinum wire electrode.

8. A method of plating platinum black onto the outer surface of a platinum substrate comprising the steps of positioning a counter electrode and said platinum substrate in a plating solution which includes chloroplatinic acid and lead ion, and passing a direct electric current through said counter electrode, platinum substrate and plating solution for a predetermined time period while simultaneously agitating said plating solution and platinum substrate with ultrasonic vibrations.

9. The method of claim 8 wherein said platinum substrate is a platinum wire electrode.

* * * * *